United States Patent [19]

Garcia

[11] 4,071,115

[45] Jan. 31, 1978

[54] MULTI-STORY LIFT DEVICE

[76] Inventor: Frank Garcia, 3047 Terrace Ave., Naples, Fla. 33942

[21] Appl. No.: 672,525

[22] Filed: Apr. 1, 1976

[51] Int. Cl.[2] ..... B66B 9/20

[52] U.S. Cl. ..... 187/2; 187/11; 187/95

[58] Field of Search ..... 187/2, 9 R, 11, 95, 187/9 E, 10

[56] References Cited

U.S. PATENT DOCUMENTS

| | | | |
|---|---|---|---|
| 783,699 | 2/1905 | Laffin | 187/9 R |
| 2,241,275 | 5/1941 | Shinn et al. | 187/11 |
| 2,284,360 | 5/1942 | Berby | 187/2 |
| 2,732,087 | 1/1956 | Pratt | 187/9 R |
| 3,003,584 | 10/1961 | Wiegand et al. | 187/9 R |

FOREIGN PATENT DOCUMENTS

| | | | |
|---|---|---|---|
| 292,329 | 2/1967 | Australia | 187/11 |

*Primary Examiner*—Robert W. Saifer
*Assistant Examiner*—Jeffrey V. Nase

[57] ABSTRACT

A multi-story lift device, fixed to a trailer for over-the-road travel to and from a job site, particularly for use in the construction industry and related trades. The trailer mounted lift device is adapted for transportation by automotive vehicles such as a passenger car, pick-up truck, etc., and includes rigid, lift guide beams, pivotally movable relative to the trailer from an inclined angle at which the total height of the structure is within the legal limit for over-the-road travel, to an elevated, generally vertical position to accommodate movement of a lift platform from ground level to elevations generally ranging from two building levels up to a practical limit, five to six building levels, for example.

5 Claims, 8 Drawing Figures

MULTI-STORY LIFT DEVICE

BACKGROUND OF THE INVENTION

It is a well known fact that in the construction industry and related trades, it is necessary to lift an abundance of very heavy material from the ground level to various elevated levels, depending upon the heighth of the structure.

Presently, a variety of heavy equipment lift devices, such as cranes, heavy forklift devices, etc., are employed for this purpose. Machinery of this nature is extremely expensive to purchase as well as to operate, and ownership of such machines is generally limited to large construction companies or the like. Small construction companies, roofers, remodeling companies, etc. must therefore have heavy materials and the like manually transported to upper levels or rent the necessary heavy equipment. Such rental fees are also quite expensive and include a substantial fee for simply transporting the equipment to and from the job site.

When manual labor is employed to accomplish a heavy lifting operation to an upper level, a considerable number of man hours of work is required and the exhausted condition of the worker or workers thusly employed reduces their working efficiency for the balance of the work day so as to add a somewhat hidden cost to the job.

The cost of the multi-story lift device of the present invention is a relatively small fraction of the cost of the aforementioned heavy lifting equipment and is well within the means of the average smaller operator. In fact, the savings effected by the elimination of high rental and transportation costs for heavy equipment or the considerable costs for manual labor will generally compensate for the full cost of the lift device of the present invention over the period of the completion of a relatively few jobs.

OBJECTS AND ADVANTAGES OF THE PRESENT INVENTION

One of the principal objects of the present invention is to provide a multi-story lift device, fixed to a trailer for over-the-road transportation to a job site in a coupled relation to a towing vehicle.

Another principal object of this invention is to provide a multi-story lift device including rigid, lift guide means, pivotally movable, relative to a trailer, from a retracted, inclined, acute angle relative thereto, to an elevated, generally vertical position to accommodate movement of a lift platform from ground level to an elevated level.

A further object of the instant invention is to provide the lift guide means relative to the trailer in a manner so as to maintain a peak heighth of the lift device in its retracted position within the legal heighth limit for over-the-road transportation.

Yet another object of the present invention is to provide winch means to pivot the lift guide means between its acutely angled, retracted position to its generally vertical position and to raise and lower the lift platform therealong.

A still further object of this invention is to provide the winch means to selectively raise or lower the lift platform along the lift guide means.

DESCRIPTION OF A PREFERRED EMBODIMENT

Figure 1:
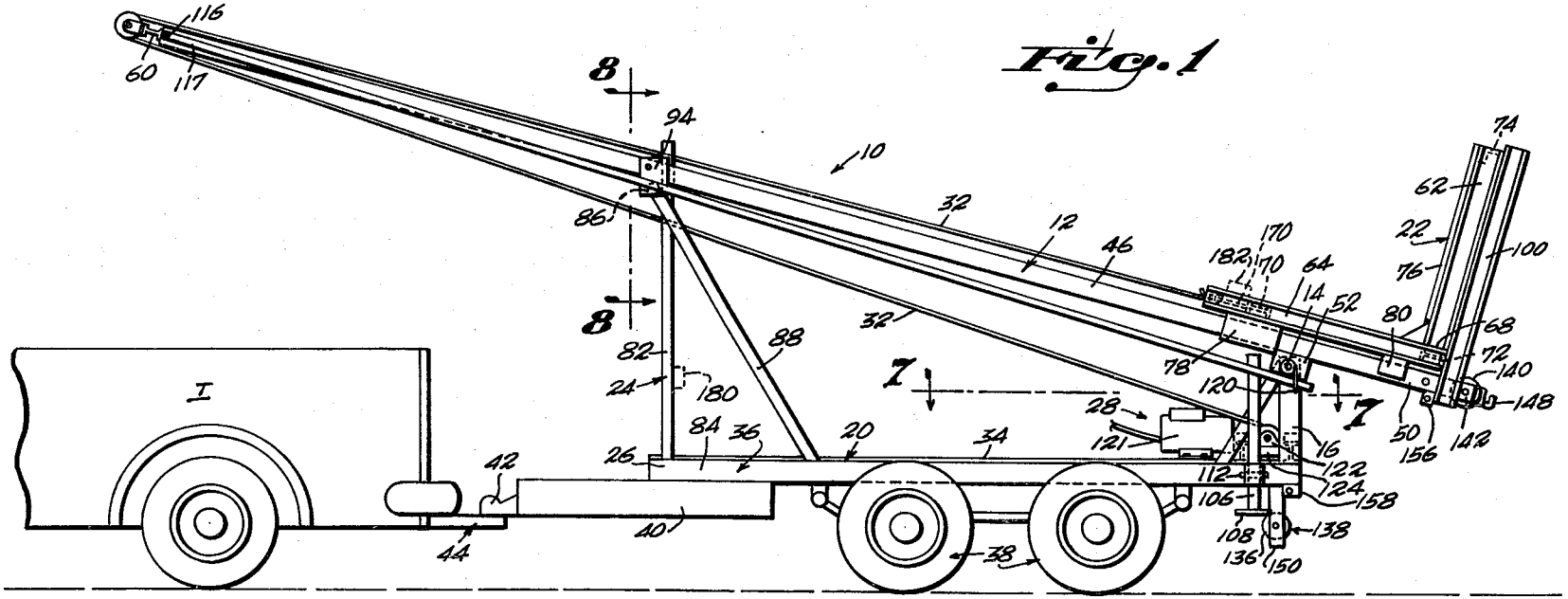
FIG. 1 is a side elevational view of the multi-story lift device of the present invention, fixed to a trailer and in a retracted position.

With reference to the drawings in which like reference characters designate like or corresponding parts throughout the various views and with particular reference to FIG. 1, the multi-story lift device of the present invention is designated generally at 10 and includes a lift guide assembly 12, pivotally attached at 14 to the upper ends of a pair of vertical posts 16 and 18, fixed as by welding to the top, rear end of a trailer 20. A lift platform assembly 22 is carried by the lift guide means 12 in a movable relation therealong. Upstanding support means 24 are fixed relative to the front end portion 26 of trailer 20 to support the lift guide means 12 in a retracted position and a power winch assembly 28 drives a first cable 30, FIG. 4, for actuation of the lift guide means 12 between the retracted position of FIG. 1 and the elevated position of FIG. 3, and a second cable 32, FIGS. 1, 2 and 3, drives the lift platform assembly 22 in a generally vertical path along lift guide means 12 between a ground level position and selected elevated positions.

In more detail, the trailer 20 is of a generally conventional type providing a bed 34, fixed to a frame assembly 36, supported by a tandem wheel assembly 38. A tongue assembly 40 is fixed to the front end portion 26 of trailer 20 and includes a front end coupler 42 for coupled engagement to a ball type hitch assembly 44 carried in a conventional manner by the rear end of a vehicle such as the truck T.

With reference to the lift guide means 12, it comprises a pair of spaced apart, parallel, tubular guide beams 46 and 48, pivoted inwardly of their lower end portions 50 at 14 to the respective vertical posts 16 and 18. A pair of ears such as 52 are fixed as by welding to the respective beams 46 and 48 to receive the pivot connections 14. The lower end portions 50 of the beams 46 and 48 are interconnected by a cross beam 54, FIG. 3, and a V-shaped truss assembly comprising an upwardly diverging pair of braces 56 and 58, fixed between the central portion of cross beam 54 and the respective beams 46 and 48. A tie beam 60 interconnects the upper, extended ends of beams 46 and 48.

With reference to the lift platform assembly 22, it comprises a pair of spaced apart, parallel beams 62—62, and a pair of right angularly disposed beams 64—64, fixed endwisely to beams 62—62 as by welding at 68. Appropriate transverse beams such as 70, 72 and 74 interconnect between the two right angular assemblies thusly formed and a platform 76 is fixed across the top span of beams 62—62.

Figure 2:
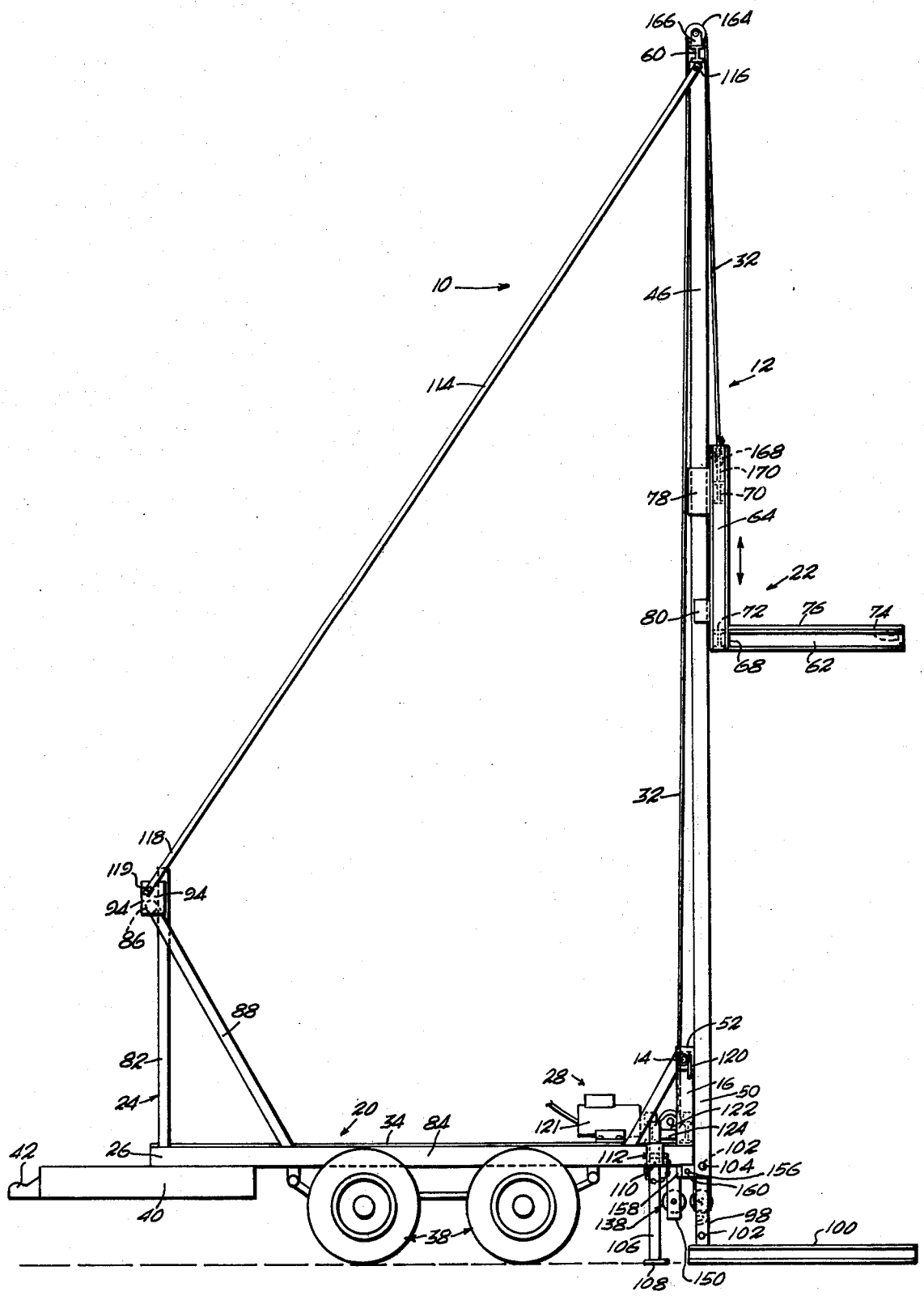
FIG. 2 is a very similar to FIG. 1 in an elevated, operable position.

As best illustrated in FIGS. 1 and 2, the beams 64—64 are disposed closely adjacent to and parallel with the respective tubular guide beams 46 and 48, and are slidably journaled therealong by a pair of tubular segments 78—78, fixed as by welding to the inside faces of the upper end portions of the respective lift beams 64—64. The tubular segments 78—78 are companionately shaped and somewhat enlarged in cross section relative to tubular guide beams 46 and 48 for sliding engagement thereover for movement substantially along the lengths thereof. Stabilizing guide means are provided in a fixed relation to the inside faces of the lower end portions of the respective beans 64—64 in the form of segments 80—80 which are generally C-shaped in cross section, being tubular segments similar to segments 78—78 with their back walls removed.

The upstanding support structure 24 comprises a pair of generally vertical posts 82—82 fixed as by welding to the front portion of the opposed side rails 84 of the trailer frame assembly 36. Spanning the upper end portions of vertical posts 82—82 in a fixed relation thereto is a transverse post 86, and a pair of angularly disposed truss posts 88—88 are connected as by welding at their lower ends to the respective trailer side rails 84 and to the end portions of vertical posts 82—82 and transverse post 86 at their upper ends.

Figure 8:
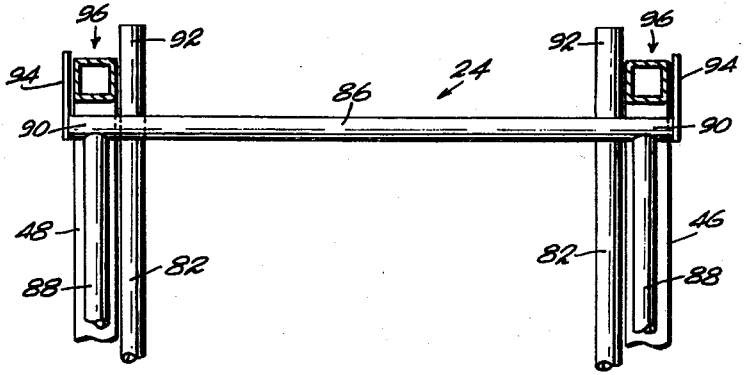
FIG. 8 is a vertical cross sectional view taken along line 8—8 of FIG. 1.

With reference to FIG. 8, the transverse post 86 provides an outwardly extending end portion 90 at each side which cooperates with an upwardly extending end portion 92 of each vertical post 82 and a plate 94, fixed as by welding to each end face of transverse post 86, to define opposed side troughs 96—96 to securely nest the tubular guide beams in their retracted positions as in FIG. 1.

At their lower ends each tubular beam 46 and 48 is provided with an interiorly telescoping support leg 98 with an elongated, rearwardly extending foot member 100 welded to the lower end thereof for reasons to be hereinafter described. Hole means such as 102 are provided in the lower end portion of each beam 46 and 48 and each support leg 98 for the reception of keeper means 104 such as a pin or bolt and nut to selectively maintain the feet 100 in the elevated or lowered positions of FIGS. 1 and 2.

A second leg 106 carrying a bottom foot 108 is slidably engaged through a U-bracket 110, fixed as by welding, inwardly of the rear end of each trailer side rail 84. Similar hole and keeper means indicated generally at 112 are provided to selectively maintain the feet 108 in the elevated or lowered positions of FIGS. 1 and 2.

An elongated brace member 114 is pivotally attached at 116 at a first end 117 to the upper extended end portion of each guide beam 46 and 48. In the elevated position of FIG. 2, each brace member 114 is attached at a second end 118 by an appropriate keeper means 119, such as a nut and bolt, to one plate 94. In the beam retracted position of FIG. 1, the second end 118 of each brace member 114 is disposed at rest in an upwardly opening hook means 120 fixed as by welding to one of the vertical posts 16 or 18.

Figure 7:
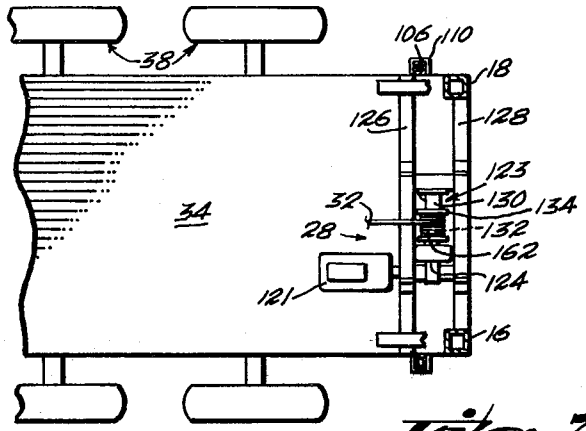
FIG. 7 is a horizontal cross sectional view taken along line 7—7 of FIG. 1.

With reference to FIG. 7, the power winch assembly 28 is mounted to the rear end portion of the trailer bed 34 and comprises a reversible electric motor 121 in driving connection to a winch 122 through an appropriate speed reducer gear box 124. The gear box 124 and winch 122 are firmly mounted and supported between a pair of spaced apart, parallel I-Beams 126 and 128, fixed in a spanning relation to the rear end of the trailer bed 34.

Figure 4:
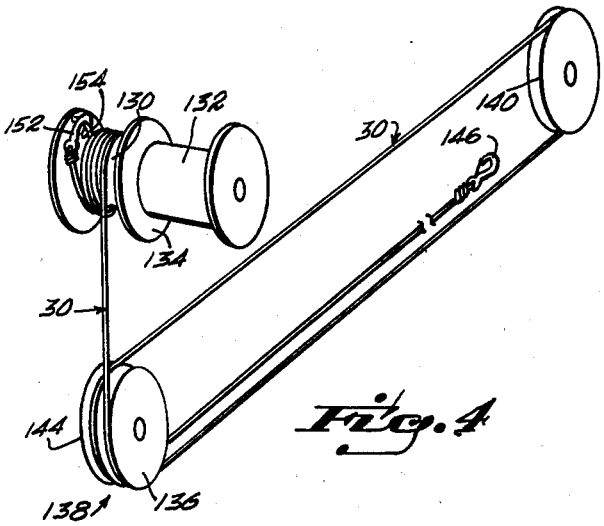
FIG. 4 is a schematic perspective view of the winch and pulley drive means for operating the lift guide means between retracted and elevated positions.
Figure 5:
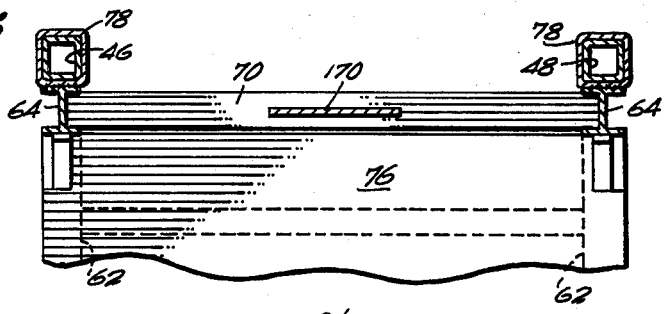
FIG. 5 is a horizontal cross sectional view taken along line 5—5 of FIG. 3.
Figure 6:
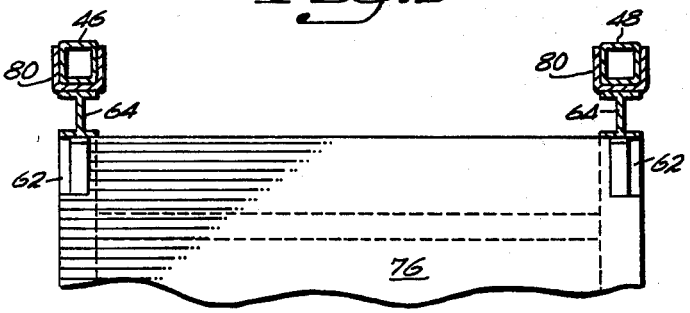
FIG. 6 is a horizontal cross sectional view taken along line 6—6 of FIG. 3.

The winch drum 123 may be divided into two portions 130 and 132 by an annular separator plate 134, the first portion 130 receives the first cable 30, FIG. 4, for actuation of the lift guide beams 46 and 48 between the retracted and elevated positions of FIGS. 1 and 2. Second winch portion 132 receives the second cable 232 to drive the lift platform assembly 22 in a generally vertical path, up-and-down between the ground level position and selective elevated positions.

Figure 3:
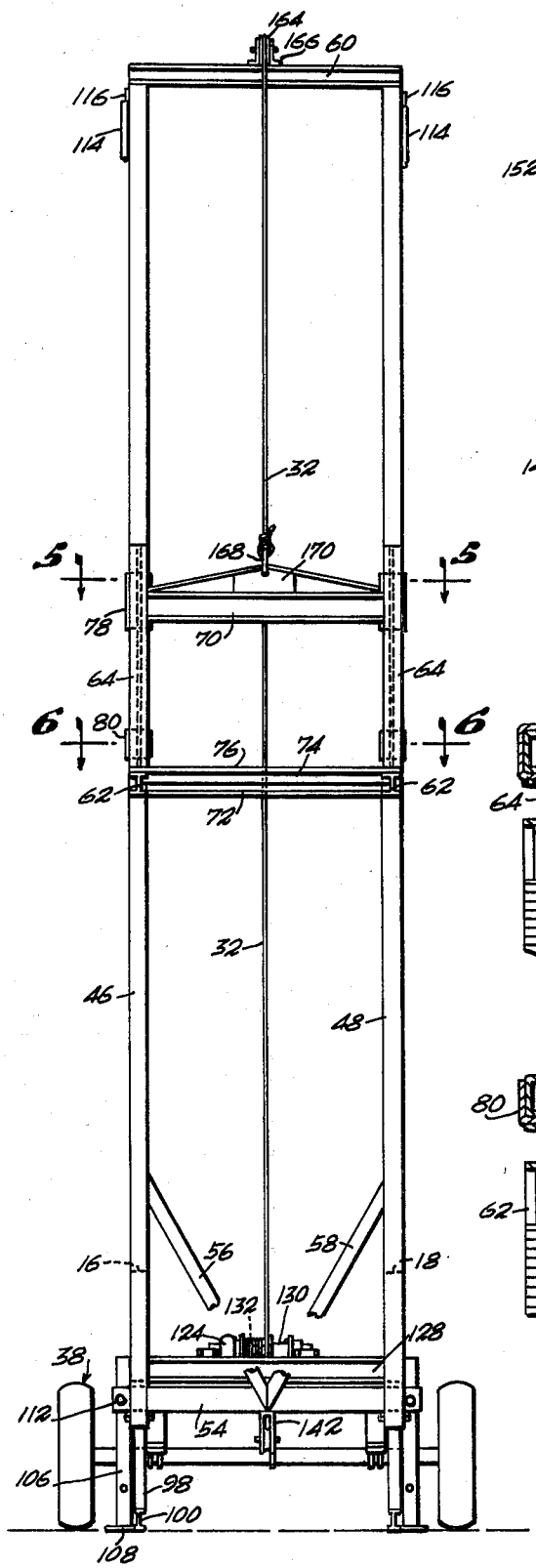
FIG. 3 is a rear elevational view of FIG. 2.

With particular reference to FIGS. 4 and FIGS. 1 and 2, the first cable 30 extends from the first winch portion 130, downwardly and around a first pulley 136, of a double pulley assembly 138, rearwardly and upwardly around a second pulley 140 rotatably carried in a bracket 142, fixed to the bottom cross beam 54 of the lift guide assembly 12 as best seen in FIG. 3. From second pulley 140, the cable extends forwardly and downwardly around a third pulley 144 of assembly 138, and then rearwardly, terminating at its outer end in a hook 146 for connection to a hook 148, fixed to a pulley bracket 142, best illustrated in FIG. 1. Double pulley assembly 138 is rotatably carried in a pulley bracket 150 fixed to the underside of the rear end portion of the trailer 20, FIGS. 1 and 2. The portion of first cable 30 disposed about the first winch portion 130 terminates with a hook 152 at its inner end for releasable engagement with an eye 154, fixed as by welding to the winch portion 130.

Referring to FIGS. 1 and 2, cooperating lugs 156 and 158 are fixed respectively to the lower end of each guide beam 46 and 48 and the rear end of each side trailer rail 84 to receive a keeper such as a pin, or nut and bolt 160 to lock the guide beams 46 and 48 in their vertical positions as in FIG. 1.

As illustrated in FIGS. 1, 2 and 3, the second cable 32 has an inner end portion 162 which may be firmly fixed in any conventional manner relative to the second winch portion 132. The cable 32 extends therefrom upwardly and around a top pulley 164, rotatably carried in a bracket 166, fixed to the top end tie beam 60 of the lift guide means 12. From top pulley 164, the cable 32 extends downwardly, terminating in a hook 168, releasably engaged through a hole in an attachment plate 170, fixed as by welding centrally of the top cross beam 70 of the platform assembly 22.

In operation, the trailer 20 is maneuvered to position the lift device at a location where materials are to be lifted to a higher level. The legs 106 on both sides of the rear end portion of the trailer are lowered to the positions of FIGS. 2 and 3 for support purposes during the elevation of the lift guide means, including the platform assembly 22, from the position of FIG. 1 to the position of FIG. 2. As above described, the first cable 30 is then engaged with the pulley drum portion 130 of winch 122 and disposed relative to pulleys 136, 140 and 144 into hooked engagement with hook 148 at the lower end of the lift guide means 12 and the motor is energized in a first direction causing the winch 122 to pivot the lift guide means 12 along with the lift assembly 22 from the retracted position of FIG. 1 to the vertical position of FIG. 2.

It should be noted that motor control means may be locatedat any convenient location on the device. Preferably, as illustrated in FIG. 1, a first switch control box for motor 121 may be located as indicated by broken lines at 180 for operation at ground level, and a second switch control box 182 may be attached to the lift assembly 22 for convenient operation by a person on the platform 76.

After the lift guide means 12 and lift assembly 22 are positioned as in FIG. 2, the keeper means 104 are disengaged to permit the telescopic legs 98 on both sides of the device to be extended to engage the elongated feet 100 with the underneath supporting surface, such as the ground, to stabilize the lift device 10 and trailer 20 for the lifting operation. The keeper means 104 are then inserted through the aligned holes 102 in the lower ends of lift beams 46 and 48 and the upper ends of legs 98 as in FIG. 2.

The lift platform assembly 22 is normally positioned and carried in the "down" position of FIG. 1 with the lift guide assembly 12 retracted. It also serves as a counter-weight for the elevating operation above described.

Therefore, the lift platform assembly 22 is normally positioned for loading at ground level after the above described elevating operation, and the first cable 30 is removed from the winch drum portion 130. With the second cable 32 connecting between the winch and the lift platform assembly 22, above described, the platform 76 may be loaded and the motor 121 energized in a first direction to move the platform assembly 22 upwardly along beams 46 and 48 to a desired level. The motor 121 is then de-energized and the load removed from platform 76. To lower the lift platform assembly the motor is energized in a second direction.

To retract the lift guide and platform assemblies 12 and 22 to their positions in FIG. 2, the first cable 30 is reinstalled and the elevating operations as above described are reversed.

The second cable 32 is detachable from the lift platform assembly 22 by means of cable hook 168 and said second cable 32 need not be removed from winch 122 during operation of first cable 30 because of its greater length. First cable 30 is readily removable from the winch drum portion 130 by means of cable hook 152 before operation of the second cable 32.

The multi-story lift device 10, illustrated in the drawings, was designed to lift substantially upward of one ton of materials to a third story level. However, the lifting capacity and the level to which a heavy load may be elevated is limited only by practical limits and the equipment and materials available for its construction.

In the retracted positions of FIG. 1, the angular relationship of the lift guide means 12 to the trailer bed 34 is designed to keep the highest point thereof within the legal limit for over-the-road travel as well as to maintain a sufficient clearance between it and the tow vehicle such as truck T.

What is claimed is:

1. A multi-story lift device for attachment to a trailer of the type including a main frame, a bed, a wheel assembly supporting the main frame and bed, and a tongue and hitch means for attachment to a tow vehicle for over-the-road travel, comprising:

elongated lift guide means pivotally connected to a first support means, fixed to the trailer, for pivotal movement between a retracted position and an elevated, generally vertical position, a lift platform means slidably journaled along the main length of said lift guide means for movement between a ground level, load position and selective elevated positions, with said lift guide means in the elevated position, a second support means for engagement by said elongated lift guide means, intermediate the length thereof, to support said lift guide means in said retracted position, winch means, fixed relative to the trailer, and a first cable, operably attached between said winch means and a lower end of said elongated chain means to pivot said elongated guide means between said retracted and elevated positions, and a second cable, operably attached between said winch means and said lift platform means to move said lift platform means between said ground level, load position and selective elevated positions, and reversible drive means, drivingly connected to said winch means, said elongated lift guide means comprising a pair of spaced apart, parallel, elongated beams, interconnected by transverse beams at their respective upper and lower ends, said lift platform means being generally L-shaped in side elevation and including a first pair of spaced apart, parallel beams, parallel with and in close proximity to the respective lift guide beams, a second pair of spaced apart, parallel beams, fixed to and extending outwardly from said first pair to define said L-shape, a platform, fixed in a spanning relation to said second pair, and a plurality of transverse tie beams connecting between said first and second pairs, said lift guide beams being tubular and including a pair of tubular segments enlarged somewhat in cross section relative to said lift guide beams for respective attachment as by welding to the upper end portions of said first pair in positions for sliding engagement along said lift guide beams, said device including a pair of generally C-shaped segments, fixed to the respective lower end portions of said first pair and being sized and configurated in cross section for a stabilizing, sliding engagement along said lift guide beams, said first support means comprising a first pair of spaced apart vertical posts, fixed relative to respective rear end sides of the trailer and said pivotal connections comprising a transverse pivot pin extending through the upper end portion of each of said vertical posts and an ear, fixed as by welding to each of said lift guide beams somewhat inwardly of said lower ends thereof, and said second support means including a second pair of vertical posts fixed at lower ends to front end portions of respective sides of the main trailer frame, and a transverse post, fixed in a spanning relation to said second pair of vertical posts, a predetermined distance downwardly from the top ends thereof, said transverse post including outwardly extending end portions beyond the respective second vertical posts for supporting engagement with said elongated beams in said retracted position.

2. The device as defined in claim 1 wherein said predetermined distance is defined by the overall, common lengths of said pair of elongated beams to position said upper ends thereof within the legal heighth above road level in said retracted position.

3. The device as defined in claim 2 including a pair of angularly disposed truss posts, fixed between the respective sides of the main trailer frame and the fixed connections between said second pair of vertical posts and transverse post.

4. The device as defined in claim 1 including a support leg, telescopically engaged in the lower end portion of each of said tubular guide beams, slidable between an extended position with an elongated foot fixed to the outer end thereof in engagement with a support surface when said lift guide beams are in their elevated positions, and a retracted position out of engagement with the support surface.

5. The device as defined in claim 1 including a vertically extending plate fixed across both ends of said transverse post.

* * * * *